US007235930B1

(12) United States Patent
Hsu

(10) Patent No.: US 7,235,930 B1
(45) Date of Patent: Jun. 26, 2007

(54) DECORATIVE TREE WITH COORDINATED VISUAL AND SOUND EFFECTS

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/465,084

(22) Filed: Aug. 16, 2006

(51) Int. Cl.
*H05B 37/02* (2006.01)

(52) U.S. Cl. ..... 315/185 R; 315/192; 315/193

(58) Field of Classification Search ..... 315/185 R, 315/186, 191, 192, 193, 185 S
See application file for complete search history.

(56) References Cited

U.S. PATENT DOCUMENTS 3,719,857 A * 3/1973 Sharp ..... 315/156
4,675,575 A * 6/1987 Smith et al. ..... 315/185 S
4,780,621 A * 10/1988 Bartleucci et al. ..... 307/11

* cited by examiner

*Primary Examiner*—David Vu
(74) *Attorney, Agent, or Firm*—James H. Walters

(57) ABSTRACT

A decorative tree uses a control circuit to operate multiple light strings and a speaker. Based on different types of music output by the speaker, the control circuit determines the light strings to be properly turned on or off. Therefore, the visual effects generated by these light strings coordinate with the output music.

8 Claims, 6 Drawing Sheets

DECORATIVE TREE WITH COORDINATED VISUAL AND SOUND EFFECTS

BACKGROUND OF THE INVENTION

1. Field of the Invention

The invention relates to a decorative tree and, in particular, to a decorative tree capable of simultaneously generating visual and sound effects coordinating with each other.

2. Description of Related Art

Electronic ornaments are developed and manufactured in recent years to enrich decorative effects. For example, a conventional Christmas tree may leave people with a monotonous impression even though colorful bulbs are decorated on the tree. Therefore, an optical fiber-based Christmas tree can generate superior visual effects than the conventional type. Such an optical fiber-based Christmas uses optical fibers as a tree frame and comprises a base and a light color changing assembly. The light color changing assembly is composed a light source, a colorful rotating disk and a motor. The light source is mounted below the rotating disk, and the rotating disk is driven by the motor. Since the rotating disk with different color regions is made of transparent material, a source light beam emitting through the rotating disk becomes a colored light beam to be guided into multiple optical fibers. As the motor drives the rotating disk, the color of the light beam guided into the optical fibers is accordingly changed.

Even though the optical fiber-based Christmas tree can change the colors of the light beam, it still has the disadvantages of high power consumption and complex structure. Further, since the rotating disk is driven with a constant speed and has only limited color regions, the Christmas tree therefor will easily lose its decorative effect.

SUMMARY OF THE INVENTION

An objective of the invention is to provide a decorative tree that is capable of generating visual effects based on characteristics of sound effects such as music rhythm, tone and instrument. With the visual effects in coordination with the sound effects, the decorative effects of the tree can be enriched.

To achieve the above-mentioned objective, the decorative tree provides a control circuit to operate multiple light strings and a speaker. Based on different types of music output by the speaker, the control circuit determines the light strings to be properly turned on or off. Therefore, the visual effects generated by these light strings coordinates with the output music.

DETAILED DESCRIPTION OF THE PREFERRED EMBODIMENT

Figure 1:
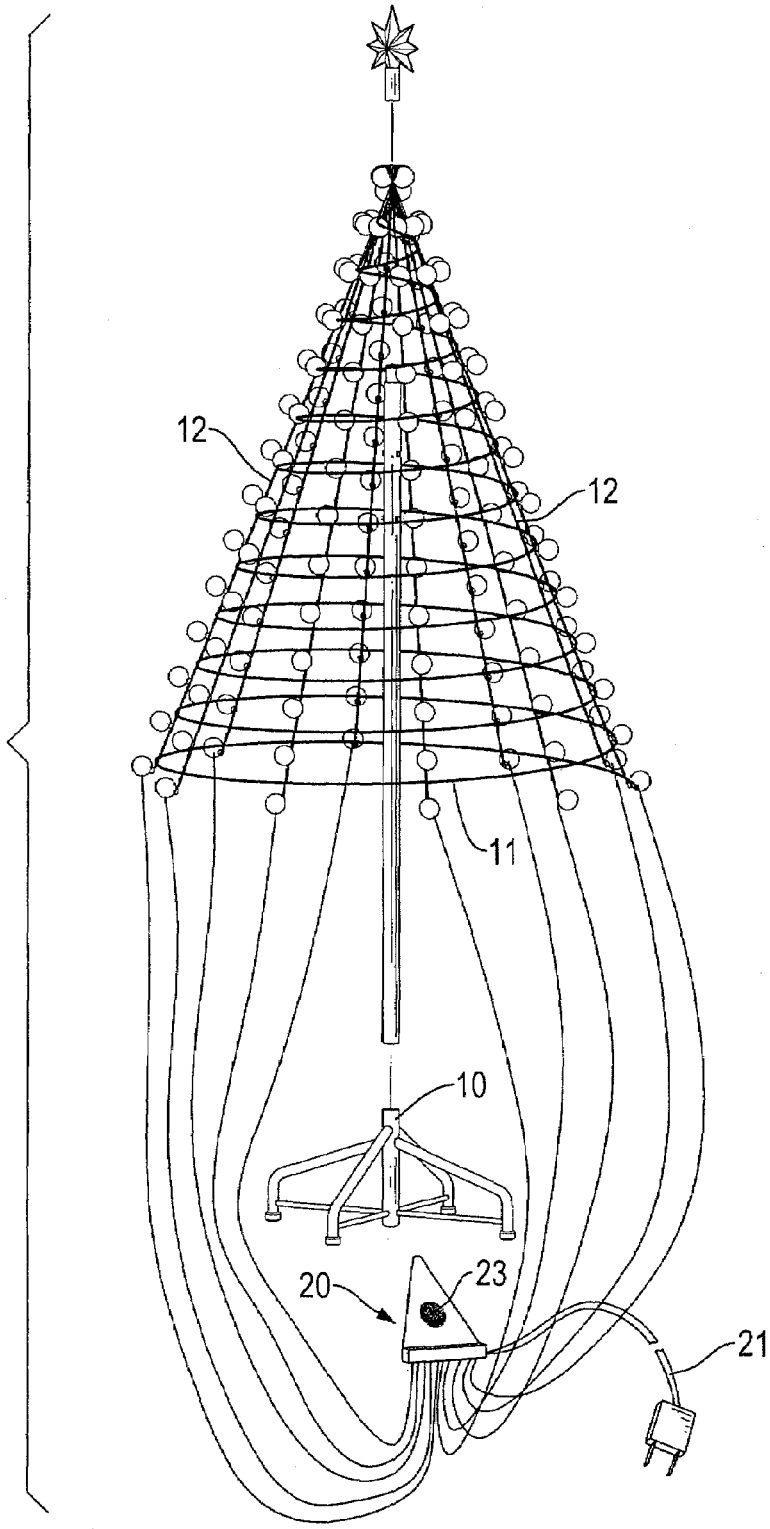
FIG. 1 is a perspective view of a decorative tree in accordance with the present invention.
Figure 2:
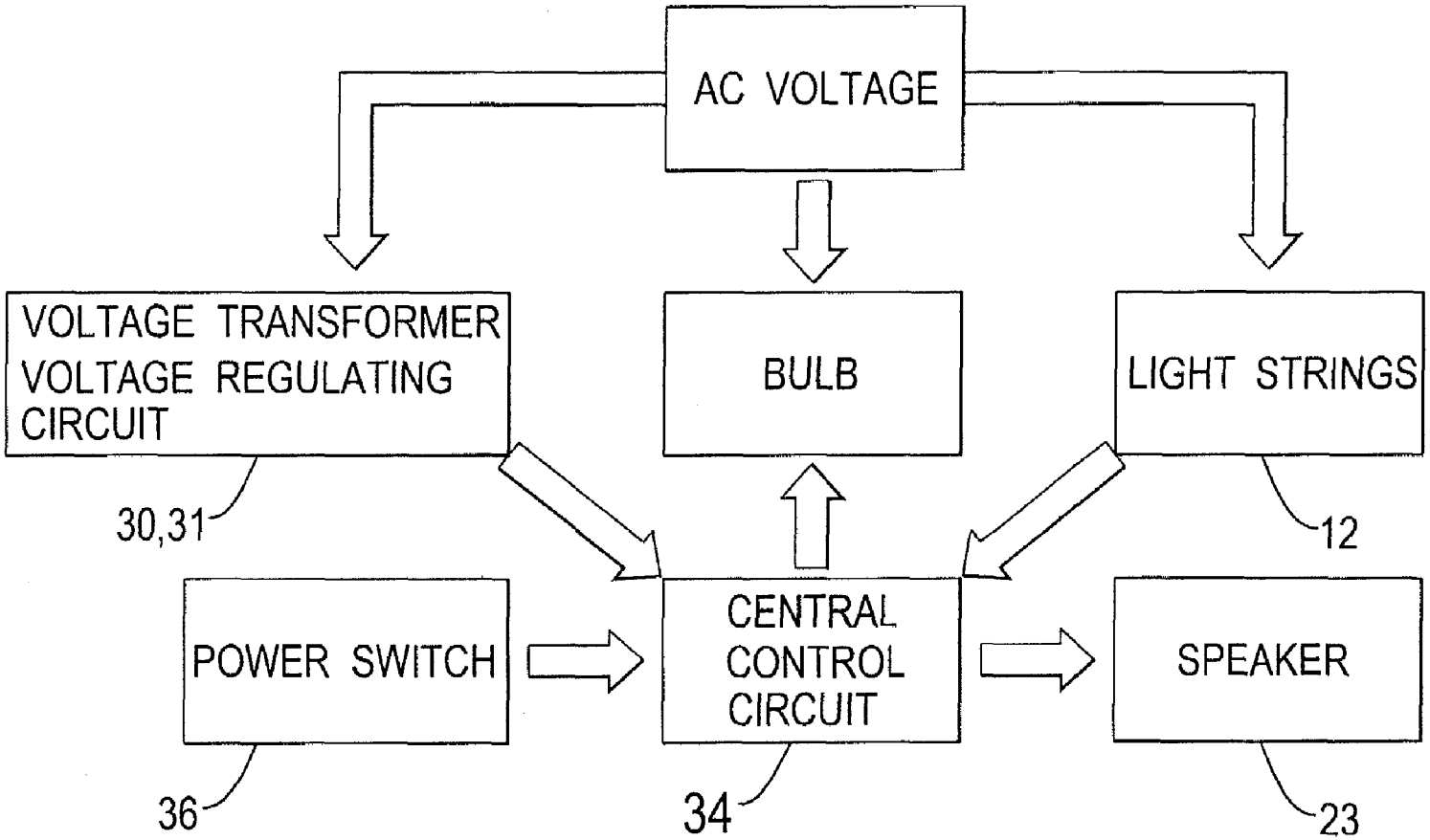
FIG. 2 is a block diagram of a control circuit for the decorative tree in accordance with the present invention.
Figure 3A:
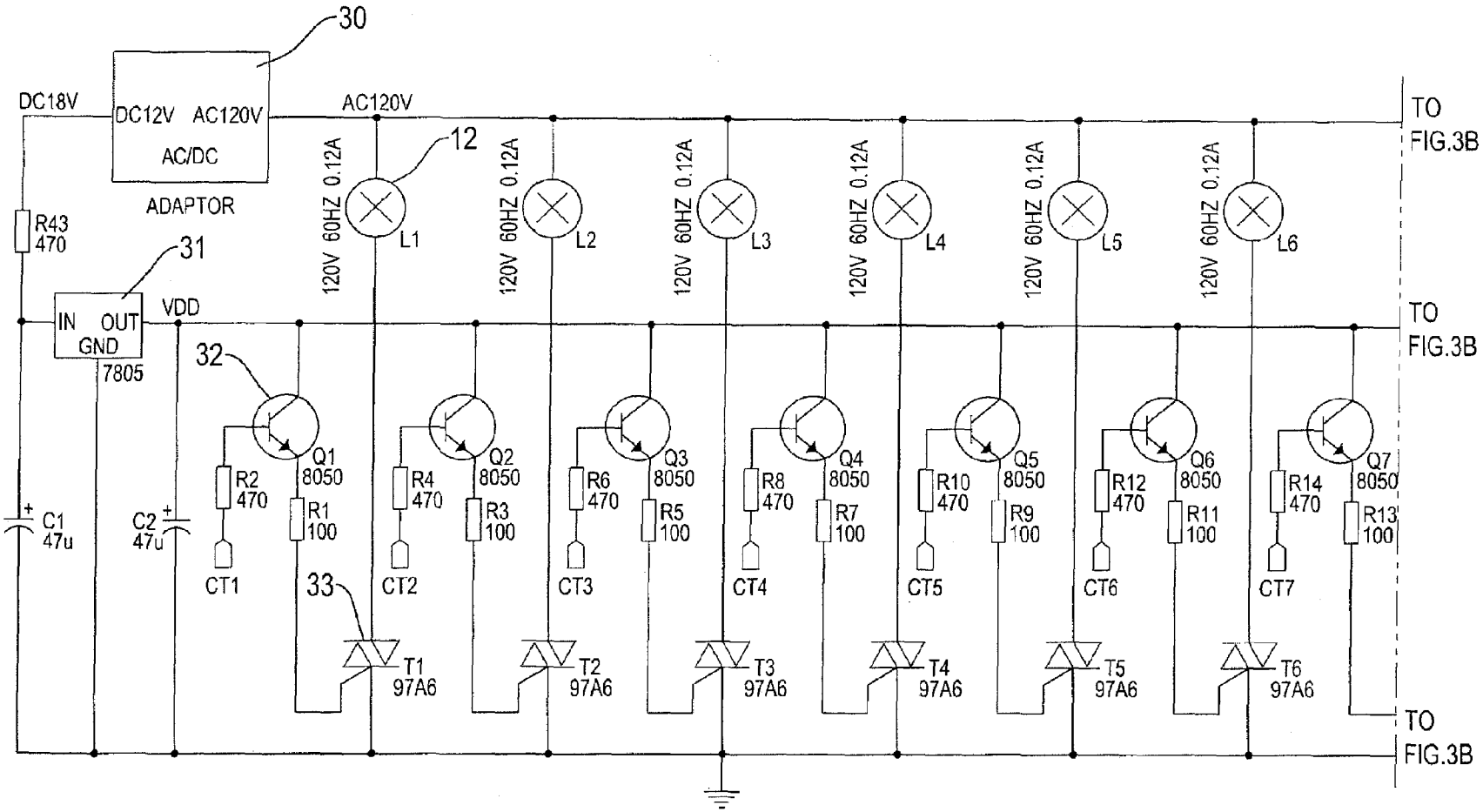
FIGS. 3A-3D show a circuit diagram of the control circuit of FIG. 2.
Figure 3B:
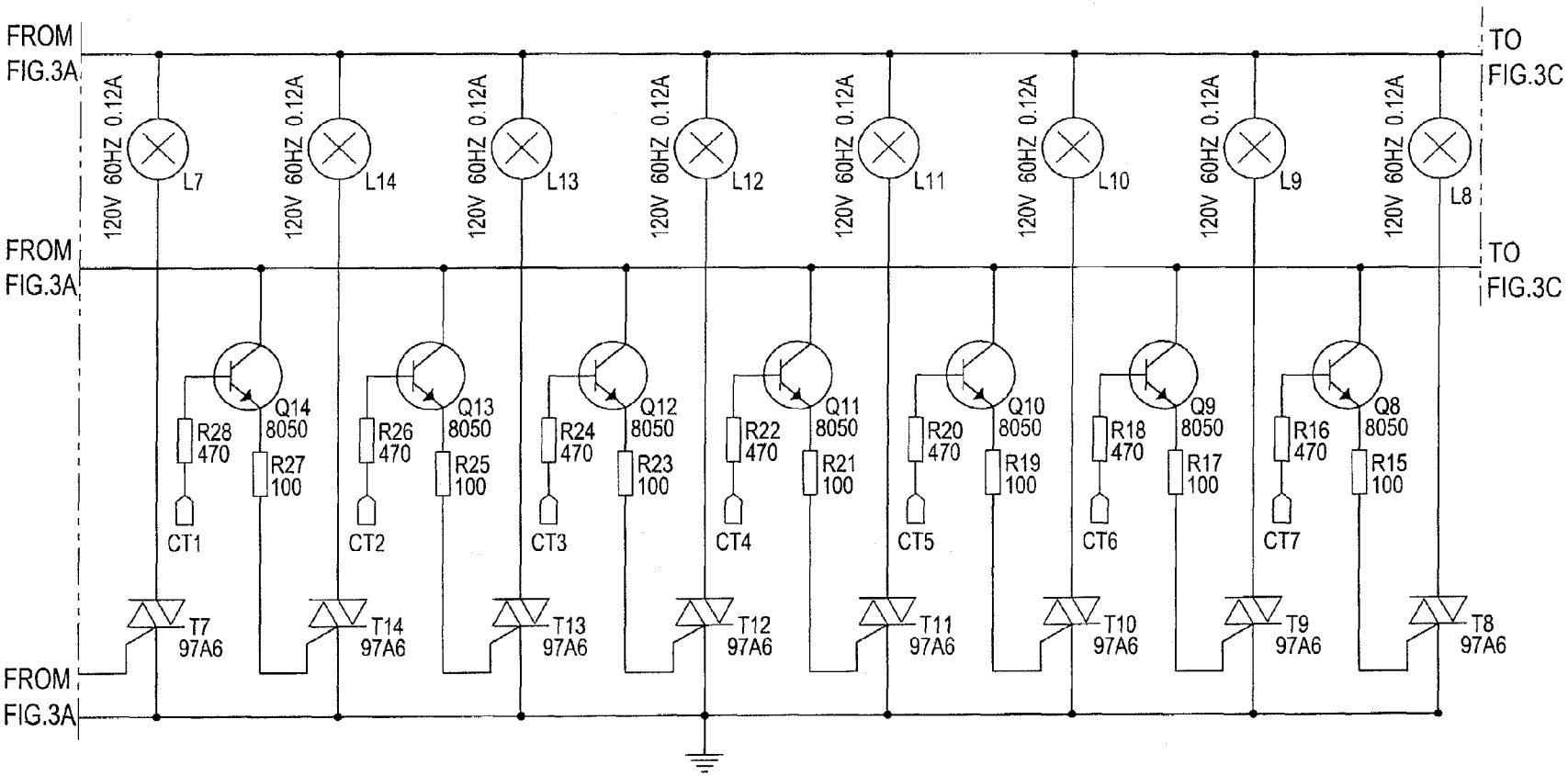
Figure 3C:
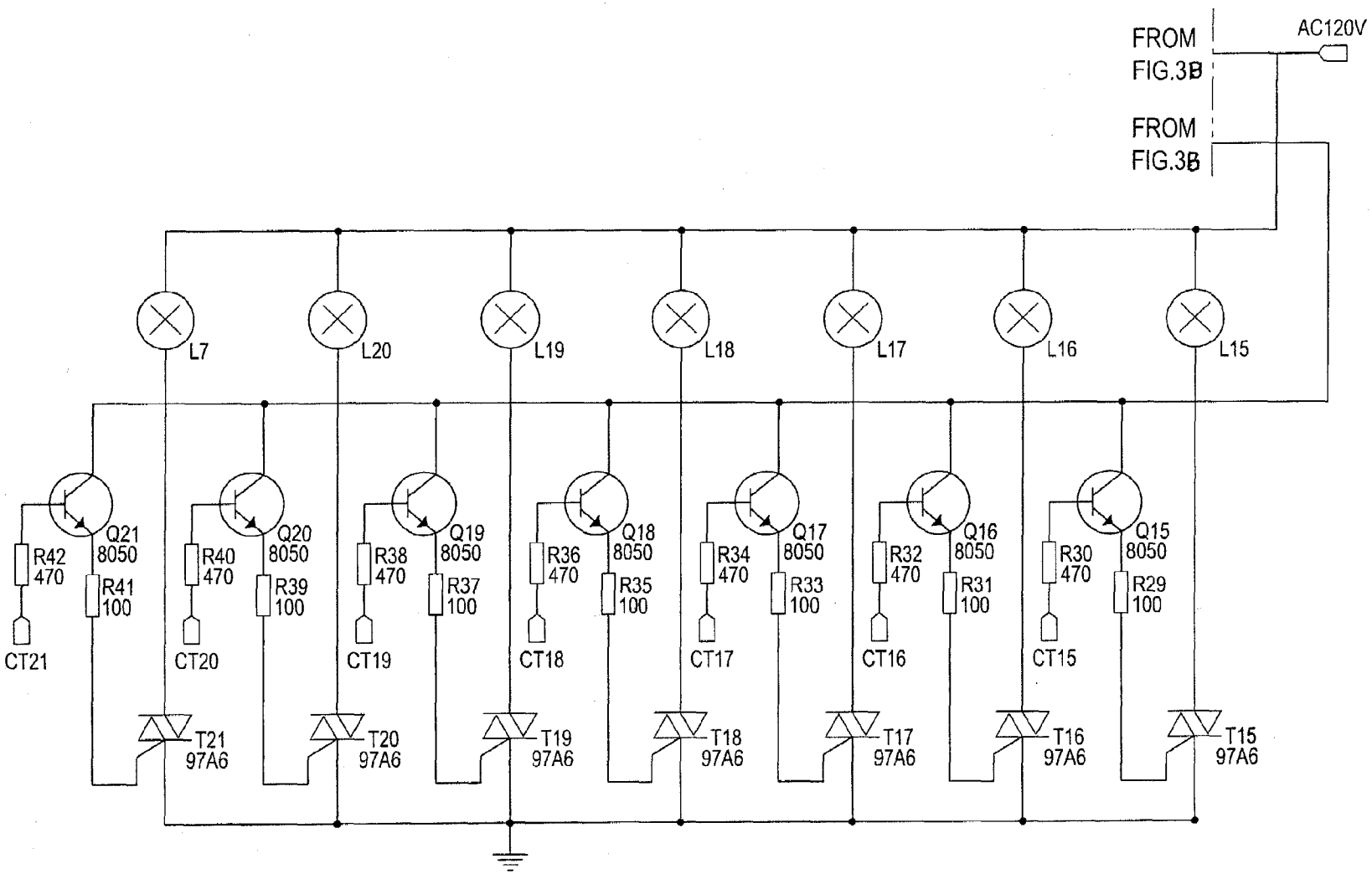
Figure 3D:
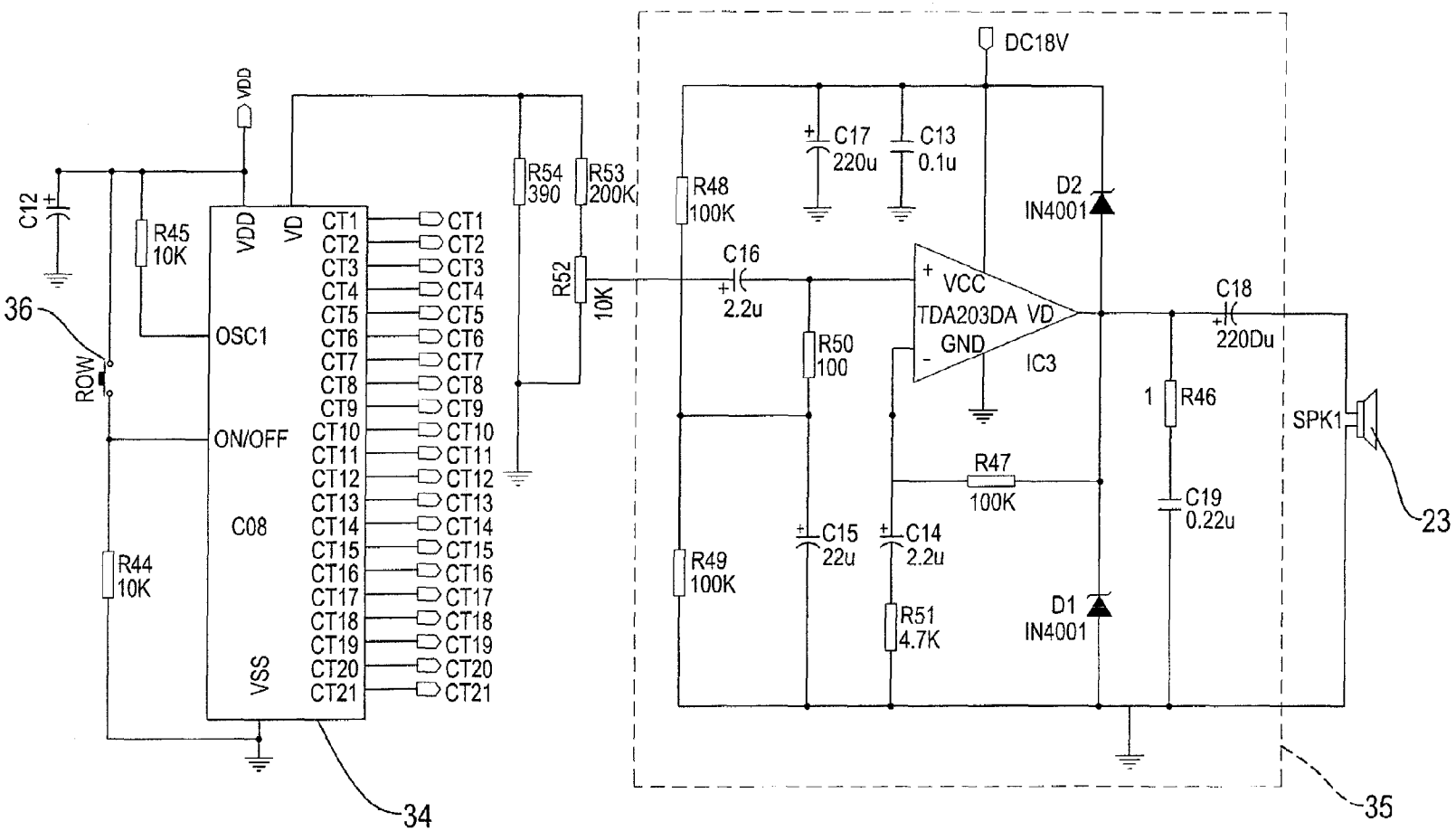

With reference to FIG. 1, a decorative tree of the present invention comprises a base (10), a tree-like stand (11) mounted on the base (10), multiple light strings (12) mounted on the tree-like stand (11) and a control box (20) connected to the light strings (12). Each of the light strings (12) is formed by multiple lighting elements.

The control box (20) determines the operations of the light strings (12) and connects with a wire (21) to receive an AC power. The control box (20) further equips with a speaker (23) to output sounds.

With reference to FIGS. 2 and 3A-3D, a circuit of the control box (20) comprises a voltage transformer (30), multiple control switches (32), multiple thyristors (TRIAC) (33), a central control circuit (34) and an audio amplify circuit (35).

The voltage transformer (30) is connected to the wire (21) to transform an input AC voltage to a first DC voltage. The first DC voltage is output to a voltage regulating circuit (31). The voltage regulating circuit (31), which can be an integrated circuit (IC), further transforms the incoming first DC voltage to a second DC voltage. In this embodiment the first DC voltage is 12 volts and the second DC voltage is 5 volts.

Each of the control switches (32) is connected between the output terminal of the voltage regulating circuit (31) and a respective thyristor (33), and has a control terminal in connection with the central control circuit (34). The control switch (32) can be implemented by a NPN transistor as shown in this embodiment, wherein a collector, an emitter and a base of the NPN transistor are respectively connect to the voltage regulating circuit (31), the respective thyristor (33) and the central control circuit (34).

Each of the multiple thyristors (33) has a first terminal, a second terminal and a trigger terminal. The first terminals of the multiple thyristors (33) connect to the multiple light strings (12) respectively. All the second terminals are connected to a ground. The trigger terminals are respectively connected to the control switches (32).

The central control circuit (34) can be implemented by an integrated circuit (IC). The central control circuit (34) has a voltage terminal connected to the output terminal of the voltage regulating circuit (34), multiple control signal output terminals (CT1 to CT11) respectively connected to the bases of the control switches (32), and an audio signal output terminal connected to the audio amplify circuit (35). The central control circuit (32) further connects with a power switch (36). When the power switch (36) is pressed, the central control circuit (34) is activated.

The audio amplify circuit (35) has an input terminal in connection with the audio signal output terminal of the central control circuit (34) and an output terminal coupled to the speaker (23).

When the central control circuit (34) outputs audio signals to the audio amplify circuit (35), the amplified audio signal processes and amplifies these audio signals and then further transmits to the speaker (23) to generate desired sound effects. The central control circuit (34) simultaneously, based on the audio signals, correspondingly outputs drive signals from its terminals (CT1 to CT11) to turn on the respective control switches (32). When the control switches (32) are turned on, a trigger voltage is input to the trigger terminals of the thyristors (33) corresponding to these control switches (32) to activate the thyristors (33). When the thyristors (33) are activated, a path is formed between the output of the voltage transformer (30). With the path, a current flows through the light string (12) to turn on the lighting elements.

In the present invention, the central control circuit (34) determines the sounds and lighting of the decorative tree. Therefore, according to different factors of music to be output, such as rhythm, tone and instrument, the light strings (12) are correspondingly turned on or turned off to generate a visual effect that coordinates with the sound effect. As an example, for strong and fast music rhythm, a higher operating frequency for the light strings is preferable to rapidly turn on or turn off the lighting elements. In addition to the operating frequency of the light strings, the multiple light strings can be selectively activated with a desired sequence.

What is claimed is:

1. A decorative tree with coordinated visual and sound effects, the decorative tree comprising:

a tree shape stand;

multiple light strings mounted on the tree shape stand; and a control box with a speaker, the control box connected to the multiple light strings and comprising:

a voltage transformer having an input terminal connected to an AC voltage and an output terminal connected to an input terminal of a voltage regulating circuit, wherein the voltage transformer transforms the AC voltage to a first DC voltage, and the voltage regulating circuit transforms the first DC voltage to a second DC voltage;

multiple thyristors connected between the light strings respectively and a ground, each thyristor having a trigger terminal;

multiple control switches respectively connected to the trigger terminals of the multiple thyristors;

a central control circuit having an audio signal output terminal and multiple control signal output terminals, the control signal output terminals respectively connected to the multiple control switches, the central control circuit outputting audio signals for the speaker and driving signals for the light strings to generate sound effects and visual effects that coordinate with each other; and an audio amplify circuit having an input terminal connected to the audio signal output terminal of the central control circuit to receive and amplify the audio signals, and having an output terminal connected to the speaker, the amplified audio signals are output by the speaker.

2. The decorative tree as claimed in claim 1, wherein each of the multiple control switches is a NPN transistor that has:

a base to receive a driving signal output from the central control circuit;

a collector connected to an output terminal of the voltage regulating circuit; and an emitter connected to a respective one of the multiple thyristors;

wherein the multiple control switches are selectively turned on by the driving signals output from the central control circuit to activate the respective light strings to generate the visual effects coordinating with the sound effects.

3. The decorative tree as claimed in claim 1, the control box further comprising a wire to connect to the AC voltage.

4. The decorative tree as claimed in claim 2, the control box further comprising a wire to connect to the AC voltage.

5. The decorative tree as claimed in claim 3, wherein the first DC voltage is 12 volts and the second DC voltage is 5 volts.

6. The decorative tree as claimed in claim 4, wherein the first DC voltage is 12 volts and the second DC voltage is 5 volts.

7. The decorative tree as claimed in claim 5, wherein the central control circuit further connects with a power switch.

8. The decorative tree as claimed in claim 6, wherein the central control circuit further connects with a power switch.

* * * * *